US009752768B2

(12) United States Patent
Roh et al.

(10) Patent No.: US 9,752,768 B2
(45) Date of Patent: Sep. 5, 2017

(54) LED LIGHTING DEVICE

(71) Applicant: KMW INC., Hwaseong-si, Gyeonggi-do (KR)

(72) Inventors: Dong-Sik Roh, Seoul (KR); Duk-Yong Kim, Yongin-si (KR); Jong-Ju Han, Suwon-si (KR); Tai-Sun Kim, Osan-si (KR); Joon-Hong Park, Suwon-si (KR); Chan-Kyu Yoo, Gyeonggi-do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 353 days.

(21) Appl. No.: 14/552,356

(22) Filed: Nov. 24, 2014

(65) Prior Publication Data

US 2016/0003465 A1 Jan. 7, 2016

(30) Foreign Application Priority Data

Jul. 4, 2014 (KR) ..... 10-2014-0083860

(51) Int. Cl.
*F21V 29/76* (2015.01)
*F21S 8/08* (2006.01)
(Continued)

(52) U.S. Cl.
CPC ..... *F21V 29/76* (2015.01); *F21S 8/03* (2013.01); *F21S 8/086* (2013.01); *F21V 7/0016* (2013.01);
(Continued)

(58) Field of Classification Search
CPC ..... F21V 29/76; F21V 29/508; F21V 29/763; F21V 7/04; F21V 23/005; F21V 23/008;
(Continued)

(56) References Cited

U.S. PATENT DOCUMENTS 7,588,355 B1 9/2009 Liu et al.
7,686,475 B2 3/2010 Koike et al.
(Continued)

FOREIGN PATENT DOCUMENTS

CN 201373264 Y 12/2009
CN 102086989 A 6/2011
(Continued)

OTHER PUBLICATIONS

International Search Report for International Application No. PCT/KR2014/011430, mailed Mar. 30, 2015 (3 pages).
(Continued)

*Primary Examiner* — Laura Tso
(74) *Attorney, Agent, or Firm* — Mintz Levin Cohn Ferris Glovsky and Popeo, P.C.; Kongsik Kim; Colleen H. Witherell

(57) ABSTRACT

An LED lighting device includes a case unit forming a light emitting space, wherein resting surfaces are formed at predetermined areas on the inner side of the case unit, substrates having LEDs mounted thereon and respectively rested on the plurality of resting surfaces, and heat-dissipating units formed in the outer side of the case unit for heat dissipation. Lifespan and user convenience can be improved.

10 Claims, 9 Drawing Sheets

(51) Int. Cl.

| | |
|---|---|
| ***F21V 7/00*** | (2006.01) |
| ***F21V 23/00*** | (2015.01) |
| ***F21V 29/508*** | (2015.01) |
| ***F21S 8/00*** | (2006.01) |
| ***F21V 7/04*** | (2006.01) |
| ***F21V 23/02*** | (2006.01) |
| ***F21V 23/06*** | (2006.01) |
| *F21W 131/103* | (2006.01) |
| *F21Y 105/10* | (2016.01) |
| *F21Y 115/10* | (2016.01) |
| *F21Y 107/10* | (2016.01) |

(52) U.S. Cl.

CPC ..... *F21V 7/04* (2013.01); *F21V 23/005* (2013.01); *F21V 23/008* (2013.01); *F21V 23/009* (2013.01); *F21V 23/023* (2013.01); *F21V 23/06* (2013.01); *F21V 29/508* (2015.01); *F21V 29/763* (2015.01); *F21W 2131/103* (2013.01); *F21Y 2105/10* (2016.08); *F21Y 2107/10* (2016.08); *F21Y 2115/10* (2016.08)

(58) Field of Classification Search

CPC ..... F21V 23/009; F21V 23/023; F21V 23/06; F21V 7/0016; F21S 8/03; F21S 8/086; F21Y 2107/10; F21Y 2105/10; F21Y 2115/10; F21Y 2101/00; F21W 2131/103

USPC ..... 362/218, 240, 247, 249.02, 294, 373, 362/431, 543, 544, 545, 547

See application file for complete search history.

(56) References Cited

U.S. PATENT DOCUMENTS

| | | | | |
|---|---|---|---|---|
| 8,203,501 | B2 | 6/2012 | Kim | |
| 8,434,899 | B2 | 5/2013 | Lee et al. | |
| 8,783,906 | B2 * | 7/2014 | Best | F21S 8/086 315/312 |
| 2009/0244927 | A1 | 10/2009 | Liu et al. | |
| 2009/0251906 | A1 * | 10/2009 | Liu | F21S 8/086 362/431 |
| 2010/0073932 | A1 * | 3/2010 | Zheng | F21K 9/00 362/249.06 |
| 2010/0135019 | A1 * | 6/2010 | Wang | F21V 29/004 362/249.02 |
| 2010/0182782 | A1 | 7/2010 | Ladewig | |
| 2010/0315813 | A1 | 12/2010 | Fugerer et al. | |
| 2011/0261567 | A1 | 10/2011 | Lee et al. | |
| 2011/0305019 | A1 * | 12/2011 | Lee | F21S 8/086 362/247 |
| 2011/0317419 | A1 | 12/2011 | Huang | |
| 2012/0243226 | A1 | 9/2012 | Wang | |
| 2012/0275155 | A1 * | 11/2012 | Kong | F21S 8/086 362/249.02 |
| 2013/0294083 | A1 | 11/2013 | Zheng | |

FOREIGN PATENT DOCUMENTS

| | | | |
|---|---|---|---|
| CN | 202469759 | U | 10/2012 |
| JP | 2007-220572 | A | 8/2007 |
| JP | 3150841 | U | 6/2009 |
| JP | 3154164 | U | 9/2009 |
| JP | 2011-210469 | A | 10/2011 |
| JP | 2013-506955 | A | 2/2013 |
| KR | 10-2011-0024087 | A | 3/2011 |
| KR | 101066667 | B1 | 9/2011 |
| KR | 10-2012-0005626 | A | 1/2012 |
| WO | WO-2012/059790 | A1 | 5/2012 |

OTHER PUBLICATIONS

Office Action dated Jan. 24, 2017 in corresponding Chinese Patent Application No. 201510023626.9.

Decision on Grant dated Dec. 19, 2016 in corresponding Japanese Patent Application No. 2014-235391.

* cited by examiner

LED LIGHTING DEVICE

CROSS-REFERENCE TO RELATED APPLICATION(S)

This application claims priority to Korean Application Serial No. 10-2014-0083860 filed on Jul. 4, 2014, which is incorporated herein by reference.

TECHNICAL FIELD

The present disclosure relates to a light emitting diode (LED) lighting device, and more particularly, to an LED lighting device of facilitating light distribution and heat dissipation.

BACKGROUND

Lately, various kinds of LED products have been developed and conventional products such as street lights, indoor lights, etc., have been replaced. One of the problems associated with LED products is that lifespan of the products may be reduced sharply by heat generated from LEDs or applied from outside. In order to overcome the problem, heat-dissipating means of various structures for dissipating heat generated from LEDs have been proposed, as disclosed, e.g., in Korean Patent No. 10-1066667 entitled "LED light using LED," which discloses a structure having a large surface area of such heat-dissipating means. However, the heat-dissipating efficiency is still not sufficient, especially for a high power LED street light device. Further, it is not convenient to inspect wirings inside the products. A need for an improved LED lighting device still exists.

The above information is presented as background information only to assist with an understanding of the present disclosure. No determination has been made, and no assertion is made, as to whether any of the above might be applicable as prior art with regard to the present disclosure.

SUMMARY

In accordance with an aspect of exemplary embodiments of the present invention, there is provided an LED lighting device including: a case unit forming a light emitting space, wherein a plurality of resting surfaces are formed at predetermined areas on the inner side of the case unit; a plurality of substrates respectively rested on the plurality of resting surfaces, wherein a plurality of LEDs are mounted on each of the plurality of substrates; and a plurality of heat-dissipating units formed in the outer side of the case unit to correspond to the resting surfaces formed in the inner side of the case unit, and configured to dissipate heat from the respective substrates. The LED lighting device enables heat-dissipating effect and/or maintenance convenience to be improved.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

The above and other aspects, features and advantages of certain exemplary embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of exemplary embodiments of the disclosure as defined by the claims and their equivalents. It includes various specific details to assist in that understanding but these are to be regarded as merely exemplary. Accordingly, those of ordinary skilled in the art will recognize that various changes and modifications of the embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of exemplary embodiments of the present disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Now, an LED lighting device according to embodiments of the present invention will be described in detail with reference to the accompanying drawings.

Figure 1:
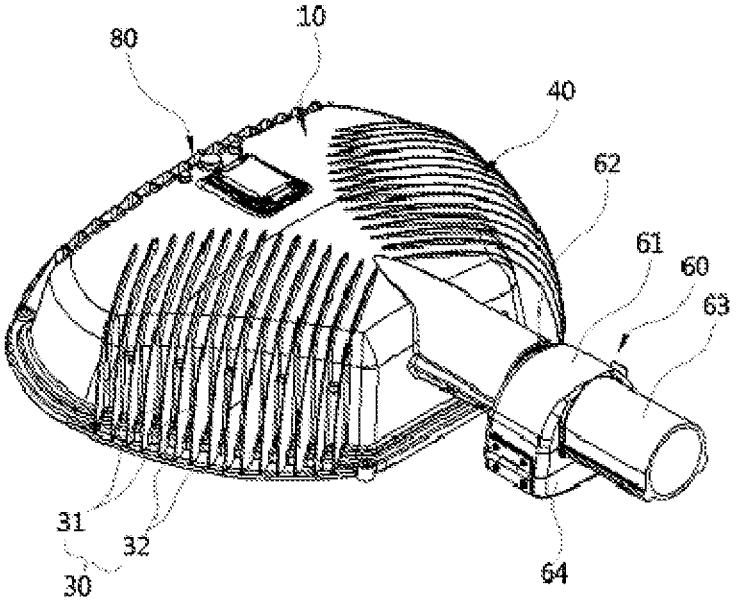
FIG. 1 is a perspective view showing an assembled state of an LED lighting device according to an embodiment of the present invention.
Figure 2:
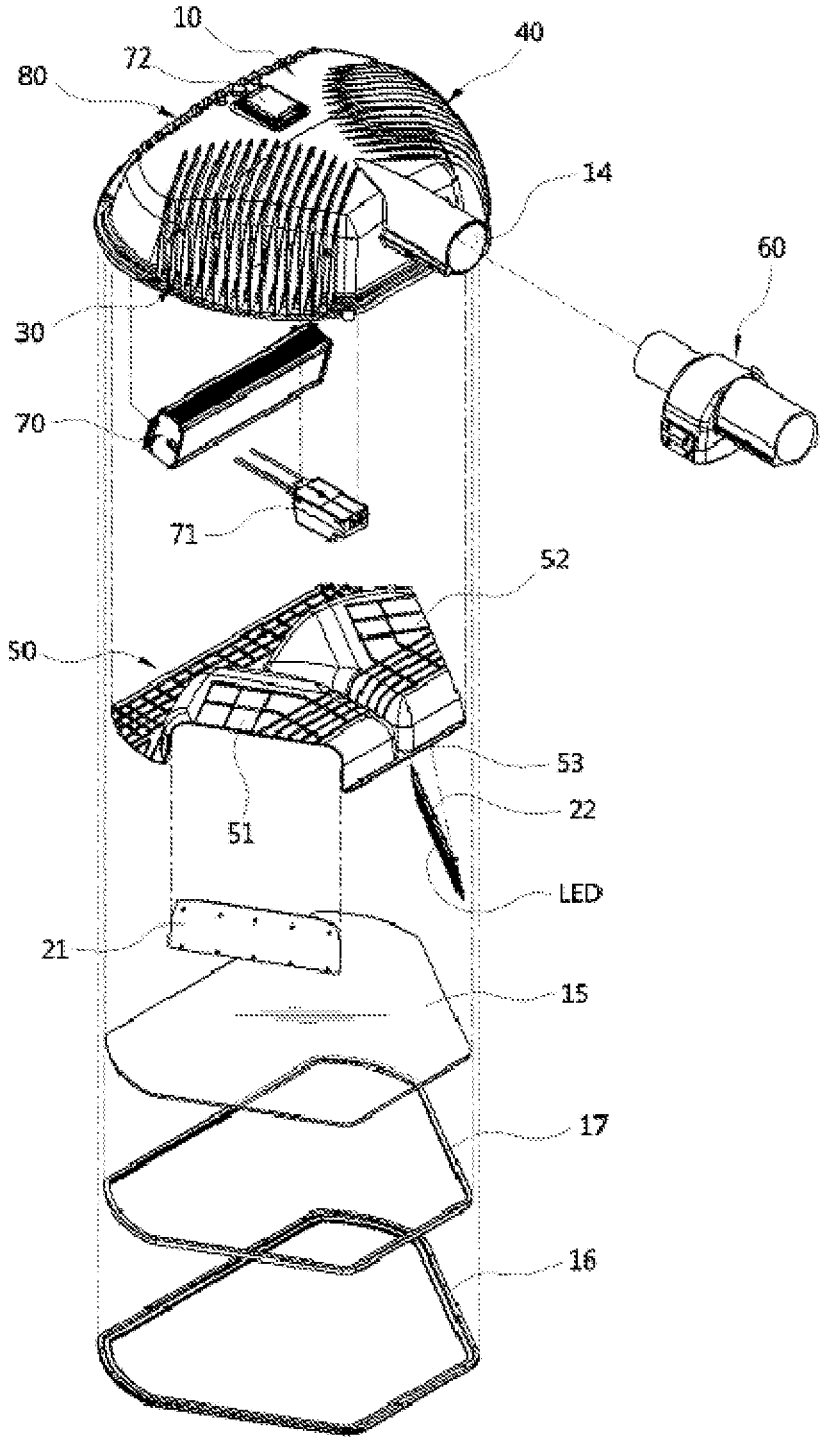
FIG. 2 is an exploded perspective view of the device of FIG. 1.
Figure 3:
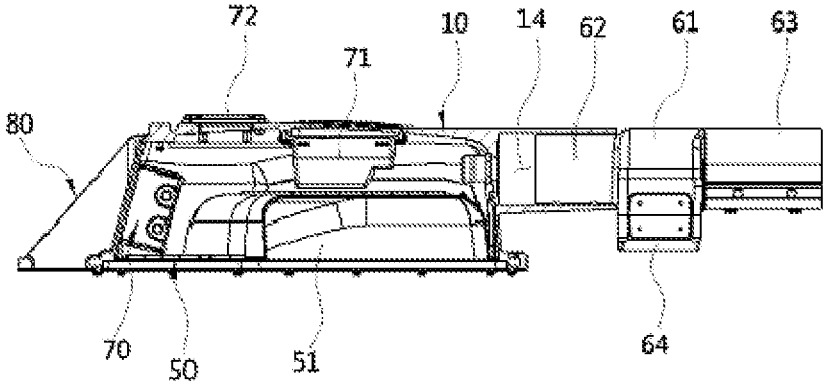
FIG. 3 is a section view of the device of FIG. 1.
Figure 4:
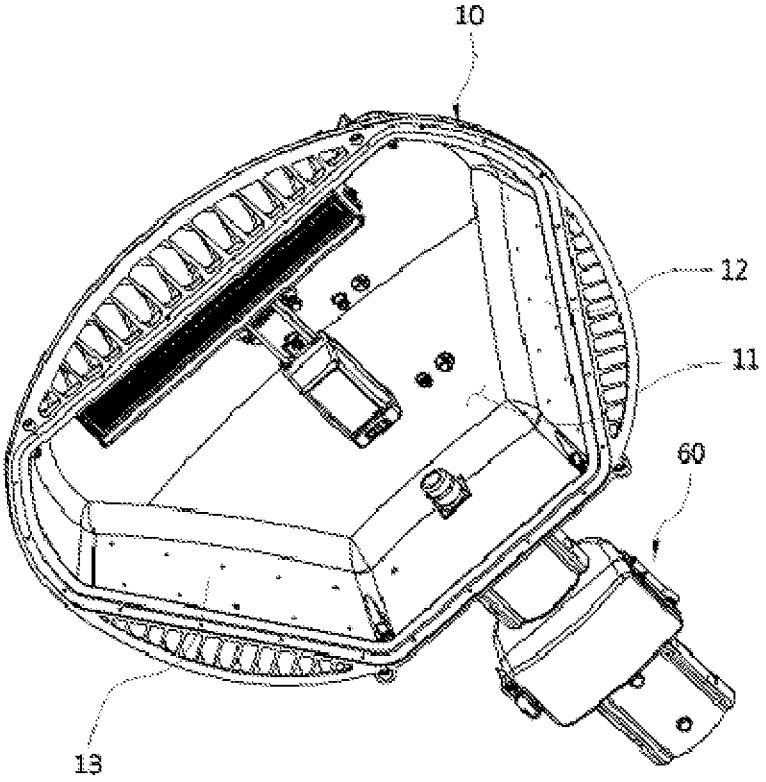
FIG. 4 is a detailed perspective view of a case unit of the device of FIG. 1.

FIG. 1 is a perspective view showing an assembled state of an LED lighting device according to an embodiment 80 of the present invention, FIG. 2 is an exploded perspective view of the device of FIG. 1, FIG. 3 is a section view of the device of FIG. 1, and FIG. 4 is a detailed perspective view of a case unit of the device of FIG. 1.

Referring to FIGS. 1 to 4, an LED lighting device according to an embodiment of the present invention may include a case unit 10, substrates 21 and 22, and heat-dissipating units 30 and 40. The case unit 10 has an accommodation space therein. The accommodation space includes a light emitting space 11 in one side thereof. Resting surfaces 12 and 13 spaced apart from each other are provided in the accommodation space. The substrates 21 and 22 are rested on the resting surfaces 12 and 13, respectively. LEDs are mounted on each of the substrates 21 and 22. The heat-dissipating units 30 and 40 are formed in an outer portion of the case unit 10. As a non-limiting example, the heat-dissipating units 30 and 40 may be positioned to correspond to the resting surfaces 12 and 13. The LED lighting device may further include a reflection unit 50 inserted in the case unit 10 for reflecting light emitted from the LEDs mounted on the substrates 21 and 22 so that the reflected light can be emitted to and/or through the light emitting space 11.

In FIG. 1, the reference numeral 15 represents a cover to cover the light emitting space 11, the reference numeral 16 represents a frame to fix the cover 15 (see FIG. 4), and the reference numeral 17 represents a seal.

Hereinafter, the configuration and function of the LED lighting device according to the embodiment of the present invention as described above will be described in more detail.

The heat-dissipating units 30 and 40 may be provided as separate components from the case unit 10. Alternatively, the heat-dissipating units 30 and 40 and the case unit 10 may be formed integrally. The shape and/or size of the case unit 10 is/are not limited to particular one(s), as long as the light emitting space 11 is formed in one side of the case unit 10, and a space is provided above the light emitting space 11.

A connecting hole 14 may be provided at a predetermined portion of the case unit 10. The connecting hole 14 may be used to connect the lighting device to an external item such as a street light post (not shown). The connecting hole 14 may be formed as a separate component from the case unit 10. Alternatively, the connecting hole 14 may be formed integrally with the case unit 10.

A connecting unit 60 may be provided in the connecting hole 14. The connecting unit 60 may be formed separately from the connecting hole 14 and/or the case unit 10. Alternatively, the connecting unit 60 may be formed integrally with the connecting hole 14 and/or the case unit 10.

The connecting hole 14 may be formed to penetrate a portion of the case unit 10. The resting surfaces 12 and 13 may be provided at both sides of the penetrating connecting hole 14 in the inside of the case unit 10. The resting surfaces 12 and 13 may act to rest and fix the substrates 21 and 22. At least one of the heat-dissipating units 30 and 40 may be positioned in the outer side of the case unit 10 corresponding to at least one of the resting surfaces 12 and 13 formed in the inner side of the case unit 10, as described above. The shape and/or number of the resting surfaces is/are not limited to particular one(s) as long as it/they can dissipate heat efficiently and prolong lifespan of the device. As a non-limiting example, as shown in the figures, LEDs may be mounted on two resting surfaces 12 and 13 to be sufficiently spaced from each other, and the respective heat-dissipating units 30 and 40 may be positioned to dissipate heat from the respective substrates 21 and 22.

The reflection unit 50 is provided for improving light distribution efficiency, among others. Light from the LEDs mounted on the substrates 21 and 22 may be reflected from the reflection unit 50, and then emitted with appropriate luminous intensity (e.g., one satisfying a certain regulation) through the light emitting space 11.

Also, the reflection unit 50 may include reflection parts 51 and 52 having a predetermined curvature for reflecting light emitted from the LEDs mounted on the substrates 21 and 22, respectively. The rejection unit 50 may further include a partition part 53 positioned between the reflection parts 51 and 52 for preventing light reflected respectively from the reflection parts 51 and 52 from traveling to the opposite sides.

The reflection parts 51 and 52 may provide light reflection spaces that are upwardly convex with respect to the emitting light emitting space 11. Luminous intensity of light emitted from the LEDs may be adjusted by determining shape, curvature and/or size, e.g., of the reflection parts 51 and 52 appropriately.

A power may be supplied to the substrates 21 and 22 to turn on the LED mounted thereon. A direct current (DC) constant voltage can be supplied, for example. An alternating current (AC) voltage can also be supplied, for example. If appropriate, a power supply unit 70 to convert the AC voltage into a DC voltage may be provided. The power supply unit 70 may be installed so that heat generated by the power supply unit 70 can be dissipated. For example, the power supply unit 70 can be installed so as to be in contact with a portion(s) of the inner surface of the case unit 10 for heat dissipation.

Also, a heat-dissipating unit 80 may be provided in the outer side of the case unit 10 so as to dissipate heat generated by the power supply unit 70. Preferably, the heat-dissipating unit 80 can be positioned at a location corresponding to the power supply unit 70. The power supply unit 70 may be fixed in the inner side of the case unit 10, and located above the reflection unit 50 in the remaining space not occupied by the reflection parts 51 and 52. In an embodiment, the heat-dissipating unit 80 may be integrated with the case unit 10 in the same shape as the heat-dissipating units 30 and 40.

The three heat-dissipating units 30, 40, and 80 may be arranged to be most spaced from each other as seen on an in-plane structure of the case unit 10. This arrangement can further improve heat-dissipating efficiency.

The heat-dissipating units 30, 40, and 80 may have the same structure. The configuration of the heat-dissipating unit 30 may be, for example, as follows. A plurality of heat-dissipating fins 31 may protrude vertically from the case unit 10, and at least one of the lower ends of the heat-dissipating fins 31 may be connected to each other through a single support part 32. With this structure, the heat-dissipating fins 31 can be further firmly supported by the support part 32, and convective circulation of heat can more efficiently dissipate heat.

According to some embodiments, the connecting unit 60 may include a wiring casing 61, a first connecting pipe 62, a second connecting pipe 63, and a door 64. The wiring casing 61 provides a space in which wires connected to the power supply unit 70 can be connected to wires provided from an external item (such as a post). The first connecting pipe 62 is connected to one end of the wiring casing 61 and inserted into the connecting hole 14, through which the wires of the power supply unit 70 can pass, and which can fix the case unit 10. The second connecting pipe 63 is connected to the other end of the wiring casing 61 that is opposite the end of the wiring casing 61, to which the first connecting pipe 62 is connected, which provides a space through which the wires from the external item can be inserted into the wiring casing 61, and which is coupled with the external item. The door 64 is provided at one side of the wiring casing 61, thereby improving user convenience. For example, an operator can open the door 64 to connect wires and/or to check wirings.

Also, an illuminance sensor 72 may be provided to control a voltage of the power supply unit 70 that is supplied to the substrates 21 and 22. Also, a communication unit 71 may be provided to perform various control operations while communicating with external devices. The above components may be formed separately from or integrally with the case unit 10.

Figure 5:
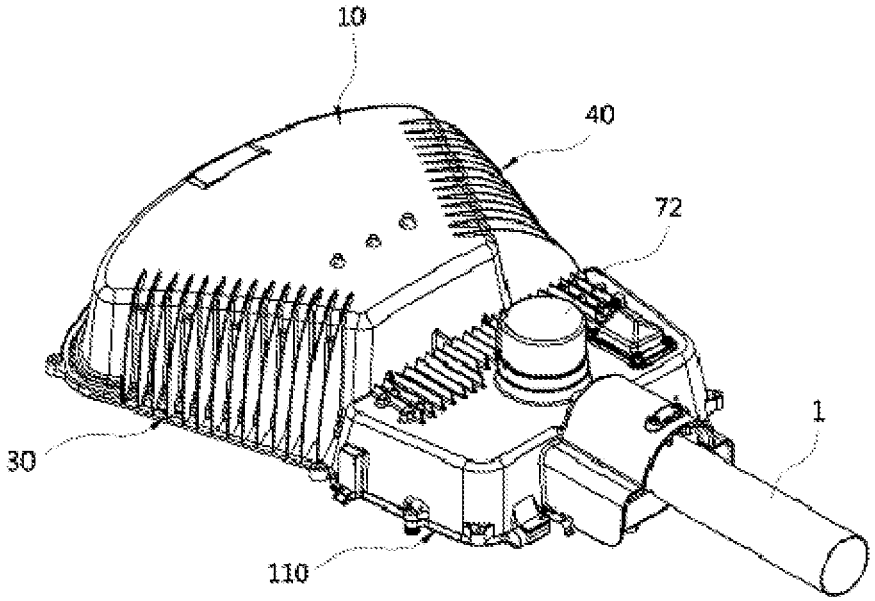
FIG. 5 is a perspective view of an LED lighting device according to another embodiment of the present invention.
Figure 6:
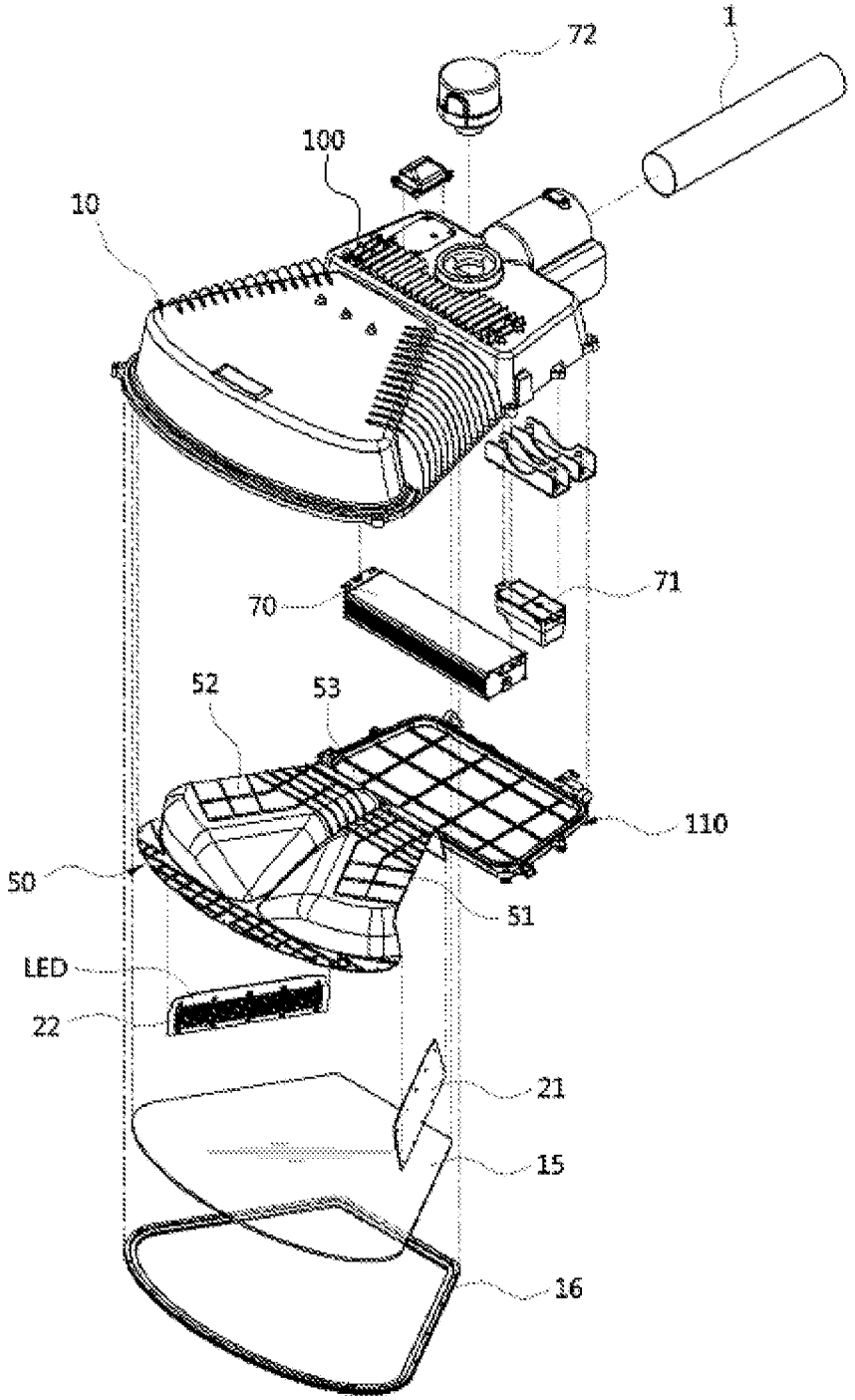
FIG. 6 is an exploded perspective view of the device of FIG. 5.

FIG. 5 is a perspective view of an LED lighting device according to another embodiment of the present invention, and FIG. 6 is an exploded perspective view of the device of FIG. 5.

The LED lighting device according to the embodiment has the same configuration as the LED lighting device as described with reference to FIGS. 1 to 4, except that the power supply unit 70 is installed in a connecting casing 100 provided at the back end of the case unit 10.

The connecting casing 100 may include a door 110 at the bottom part. An operator may open the door 110 to check wiring between the power supply unit 70 and external wires.

Although the device according to the embodiment of FIG. 5 is described not to have the connecting unit 60, it may include the connecting unit 60 depending on design needs.

Figure 7:
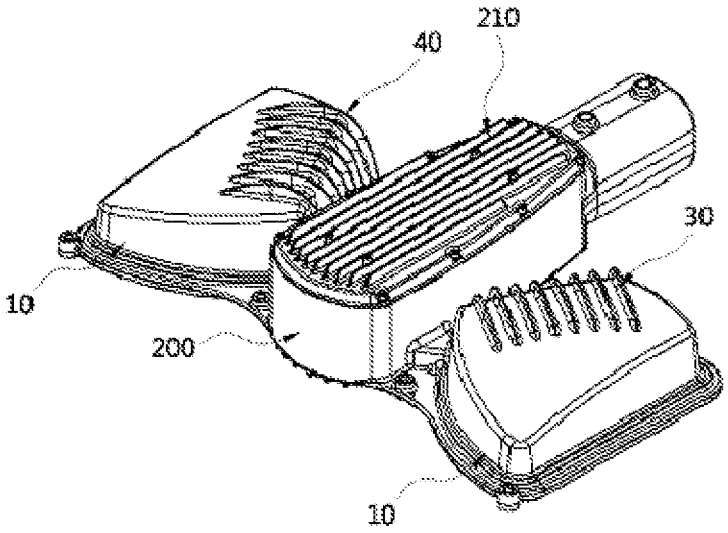
FIG. 7 is a perspective view of an LED lighting device according to still another embodiment of the present invention.
Figure 8:
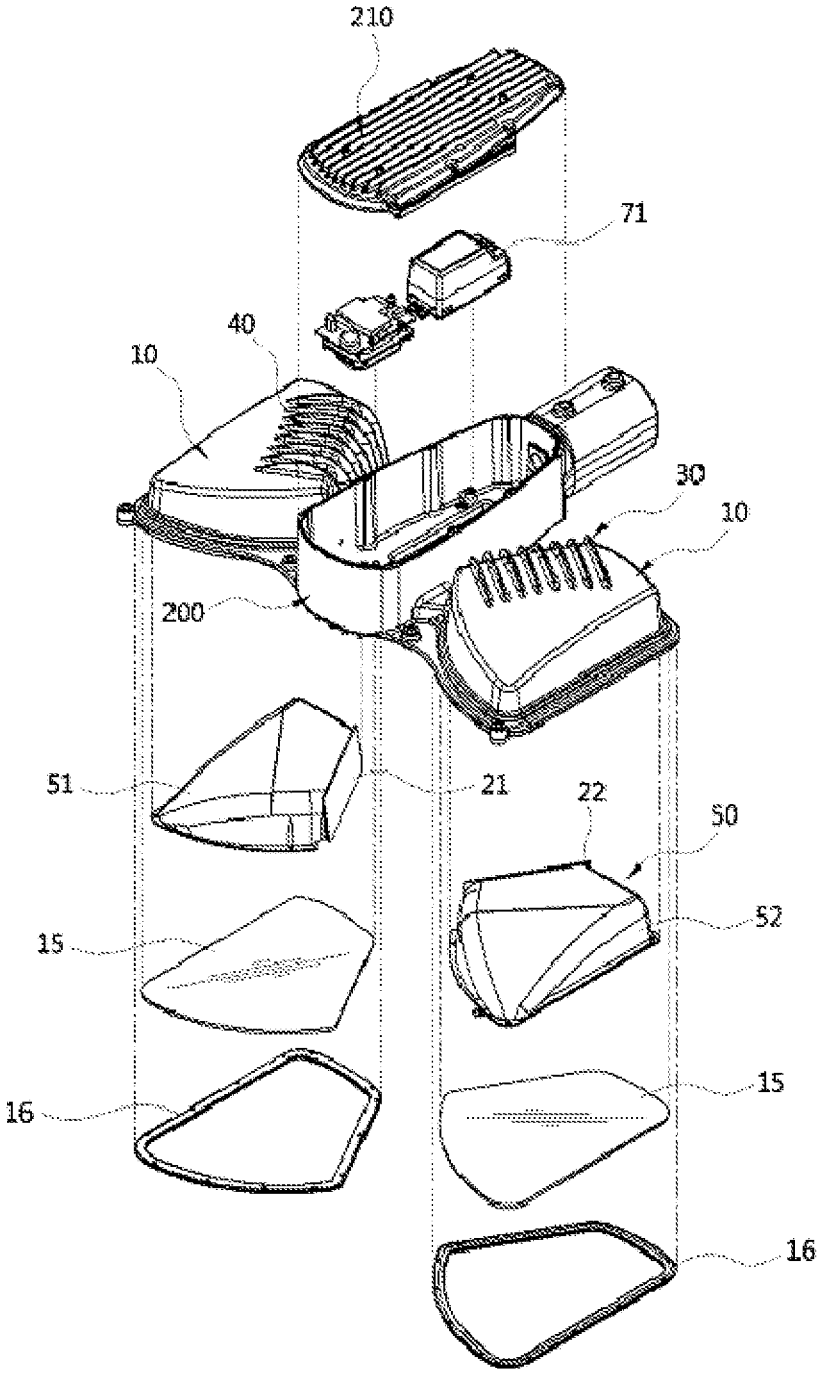
FIGS. 8 and 9 are exploded perspective views of the device of FIG. 7.
Figure 9:
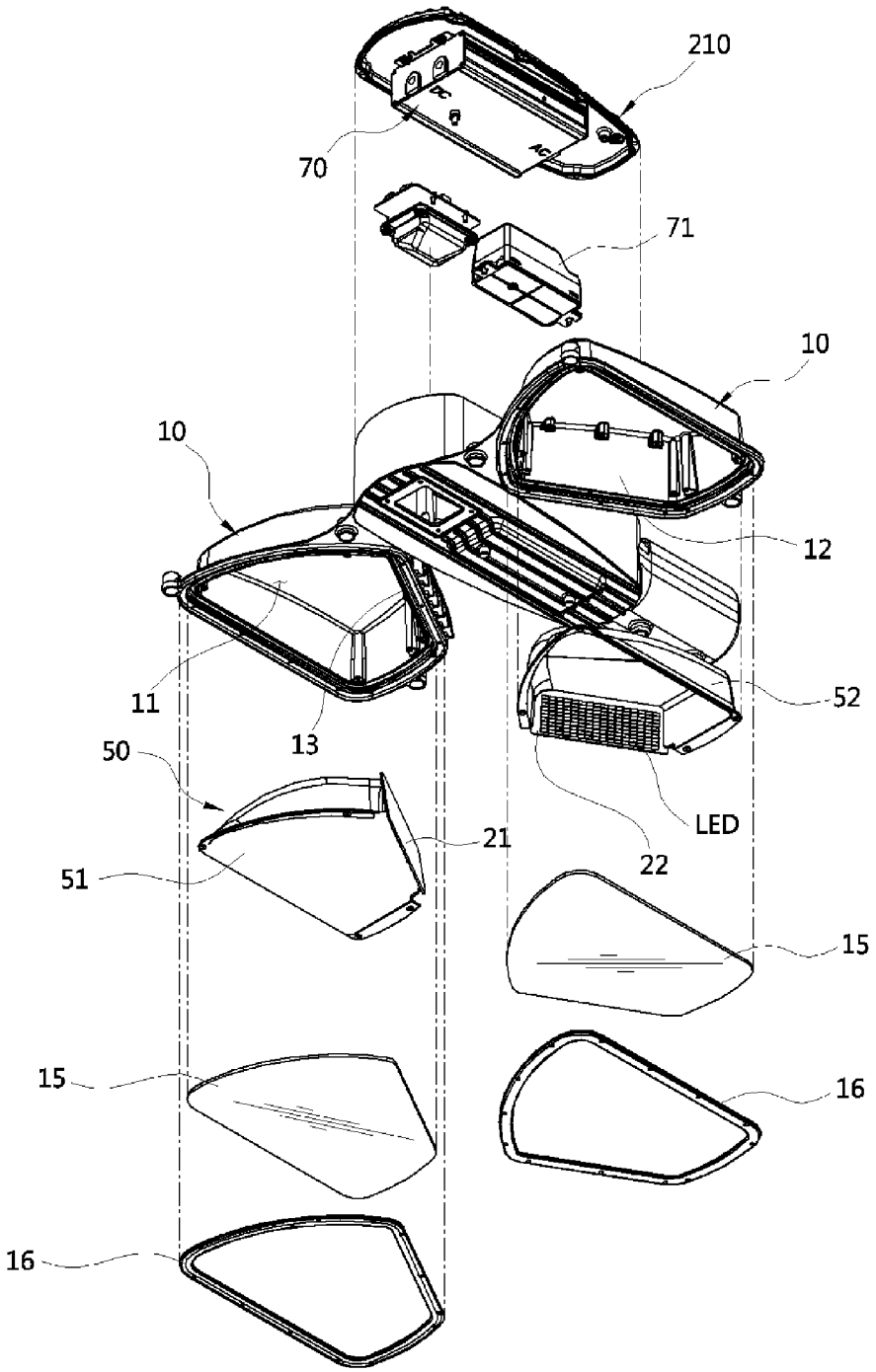

FIG. 7 is a perspective view of an LED lighting device according to still another embodiment of the present invention, and FIGS. 8 and 9 are exploded perspective views of the device of FIG. 7.

The LED lighting device may include a connecting casing 200 that can accommodate a power supply unit 700. The case unit 10 and all or part of the other components of the device described in FIGS. 1 to 4 may be provided at each of both sides of the connecting casing 200. Alternatively, the case unit 10, the connecting unit 100, and all or part of the other components of the device described in FIGS. 5 to 7 may be provided at each of both sides of the connecting casing 200. Also alternatively, the case unit 10 and all or part of the other components of the device described in FIGS. 1 to 4 may be provided at one of both sides of the connecting casing 200 while the case unit 10, the connecting unit 100, and all or part of the other components of the device described in FIGS. 5 to 7 may be provided at the other of both sides of the connecting casing 200.

In this structure, the resting surfaces 12 and 13 on which the substrates 21 and 22 are respectively rested may be provided in each of the case units 10, light emitted from LEDs provided on the substrates 21 and 22 installed on the resting surfaces 12 and 13 may be respectively reflected by the reflection parts 51 and 52 of the reflection unit 50 and then emitted through the light emitting space 11, and/or the respective case units 10 may include heat-dissipating units 30 and 40 for dissipating heat generated from the substrates 21 and 22, as described above.

Since the connecting casing 200 is provided between the case units 10, the curvature of the reflection parts 51 and 52 may be appropriately adjusted in order to adjust luminous intensity of light emitted through the light emitting spaces 11 of the case units 10.

The connecting casing 200 may include a cover 210 so that an operator can open the cover 210 to connect the power supply unit 70 to external wires and/or check the wirings.

With LED lighting devices according to the embodiments as described above and other embodiments of the present invention, longer life span and/or greater user convenience can be attained.

While the disclosure has been shown and described with reference to certain exemplary embodiments thereof, it will be understood by those skilled in the art that various changes in form and details may be made therein without departing from the spirit and scope of the disclosure as defined by the appended claims and their equivalents.

What is claimed is:

1. An LED lighting device comprising:

a case unit forming a light emitting space, wherein a plurality of resting surfaces are formed at predetermined areas on the inner side of the edge of the case unit;

a plurality of substrates respectively rested on the plurality of resting surfaces, wherein a plurality of LEDs that emit light in an inward direction of the case are mounted on each of the plurality of substrates;

a plurality of heat-dissipating units formed in the outer side of the case unit for heat dissipation; and a reflection unit inserted in the case unit, and configured to reflect light emitted from the LEDs mounted on the plurality of substrates so that the reflected light is emitted through the light emitting space, wherein the reflection unit includes curved reflection parts for reflecting light emitted from the LEDs, respectively and a partition part positioned between the reflection parts for preventing light reflected respectively from the reflection parts from traveling to the opposite sides.

2. The LED lighting device of claim 1, wherein the reflection unit comprises a plurality of reflection parts having a predetermined curvature or curvatures and having upwardly convex surfaces in the light emitting space.

3. The LED lighting device of claim 1, further comprising a power supply unit attached to the inner side of the case unit at a predetermined location above the reflection unit, wherein a heat-dissipating unit is provided in the outer side of the case unit at a location to dissipate heat generated by the power supply unit.

4. The LED lighting device of claim 3, wherein the heat-dissipating units that dissipate heat from the plurality of substrates are separate from the heat-dissipating unit that dissipate heat from the power supply unit.

5. The LED lighting device of claim 4, wherein each of the heat-dissipating units is composed of a plurality of heat-dissipating fins arranged vertically, and a support part to be connected to at least one of ends of the plurality of heat-dissipating fins.

6. The LED lighting device of claim 4, wherein a connecting unit to connect the case unit to an external item is provided at one end of the case unit.

7. The LED lighting device of claim 1, further comprising a connecting casing provided in an end of the case unit, and configured to accommodate a power supply unit.

8. The LED lighting device of claim 7, wherein the connecting casing comprises a door that can be opened and closed.

9. The LED lighting device of claim 1, further comprising a connecting casing in which a power supply unit is installed, wherein the case unit is fixed at each of both sides of the connecting casing.

10. The LED lighting device of claim 9, wherein the connecting casing comprises a removable cover.

* * * * *